US007849715B2

(12) United States Patent
Starbuck et al.

(10) Patent No.: US 7,849,715 B2
(45) Date of Patent: Dec. 14, 2010

(54) VARIABLE POWER ZONE SPACER FABRIC

(75) Inventors: Michael Frederick Starbuck, Earl Shilton (GB); Joanne Kaye, New York, NY (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 975 days.

(21) Appl. No.: 11/705,639

(22) Filed: Feb. 13, 2007

(65) Prior Publication Data

US 2007/0238392 A1 Oct. 11, 2007

(51) Int. Cl.
*D04B 7/04* (2006.01)

(52) U.S. Cl. ..... 66/171; 66/196

(58) Field of Classification Search ..... 66/171, 66/172 E, 177, 176, 196; 450/156, 75
See application file for complete search history.

(56) References Cited

U.S. PATENT DOCUMENTS

| | | | | |
|---|---|---|---|---|
| 5,133,196 | A | 7/1992 | Tibbals, Jr. | 66/35 |
| 5,359,865 | A | 11/1994 | So | 66/19 |
| 5,896,758 | A * | 4/1999 | Rock et al. | 66/191 |
| 6,145,348 | A * | 11/2000 | Hardegree et al. | 66/192 |
| 6,623,681 | B1 | 9/2003 | Taguchi et al. | 264/211.15 |
| 6,645,040 | B2 * | 11/2003 | Rabinowicz et al. | 450/1 |
| 6,755,052 | B1 * | 6/2004 | Sytz | 66/196 |
| 6,779,367 | B2 * | 8/2004 | Mitchell et al. | 66/176 |
| 6,779,369 | B2 | 8/2004 | Shepherd | 66/196 |
| 7,028,509 | B2 * | 4/2006 | Mitchell et al. | 66/176 |
| 7,048,985 | B2 * | 5/2006 | Mack et al. | 428/111 |
| 7,076,974 | B1 * | 7/2006 | Chen | 66/195 |
| 7,214,120 | B2 * | 5/2007 | Kaye et al. | 450/39 |
| 7,441,418 | B2 * | 10/2008 | Delgado-Mecinas | 66/177 |
| 7,565,821 | B2 * | 7/2009 | Park et al. | 66/195 |
| 7,611,999 | B2 * | 11/2009 | McMurray | 442/304 |
| 7,614,256 | B2 * | 11/2009 | Mitchell | 66/179 |
| 2004/0097151 | A1 * | 5/2004 | McMurray | 442/304 |
| 2004/0168479 | A1 * | 9/2004 | McMurray | 66/202 |
| 2007/0238392 | A1 * | 10/2007 | Starbuck et al. | 450/1 |

* cited by examiner

*Primary Examiner*—Danny Worrell
(74) *Attorney, Agent, or Firm*—Womble Carlyle Sandridge & Rice, PLLC

(57) ABSTRACT

A fabric having a first surface, a second surface opposite the first surface and an intermediate surface between the first surface and the second surface is provided. At least one of the first surface and the second surface is knitted with at least one elasticized yarn at at least one predetermined zone to provide a selected zone of elasticity to at least one of the first surface or the second surface of the fabric.

19 Claims, 5 Drawing Sheets

VARIABLE POWER ZONE SPACER FABRIC

BACKGROUND OF THE INVENTION

1. Field of the Invention

The present invention relates to a spacer fabric for a garment. More particularly, the present invention relates to a spacer fabric for a garment having elasticized yarns selectively knitted into the spacer fabric of a garment. Still more particularly, the present invention relates to a spacer fabric for a garment having selectively and/or intermittently knitted in elasticized yarns to create zones of predetermined and variable moduli of elasticity throughout the garment.

2. Related Art

Garments, particularly undergarments, must be designed to accommodate a variety of functions, such as, providing necessary comfort, support and modesty. In addition these expected functions, the undergarment also offer support in desired locations and be lightweight and aesthetically appealing. Consumers expect these attributes in a single undergarment without compromising on affordability. For manufacturers to satisfy their consumers, the desired attributes must be balanced against production costs in order to produce an undergarment that is competitive in the market.

For example, brassieres are often manufactured in the lamination or cut-and-sew manner to provide areas of distinct properties. Various pieces of fabric can be made of different knits, different yarns, etc. that are laminated or sewn together to form the brassiere. However, such methods for making brassieres can be disadvantageous because the process entails a large number of placing and heating steps or manual cutting and sewing operations that are time consuming and costly.

Alternatively, manufactures often use circular knitting to produce cost effective seamless blanks, that are cut, folded and sewn to quickly produce a seamless brassiere. The circular knitting process is very efficient; however, different areas of support or zones cannot often be incorporated into a single lightweight and comfortable brassiere that also offers modesty and support.

Therefore, a need exists for a circular knitted spacer fabric that selectively and/or intermittently has knitted in specific yarns to create knitted zones of predetermined and variable moduli of elasticity in a fabric that offers modesty and support.

SUMMARY OF THE INVENTION

The present invention provides a spacer fabric having elasticized yarns selectively and/or intermittently knitted into a facing layer of the spacer fabric.

Also, the present invention provides a circularly knitted spacer fabric having elasticized yarns selectively and/or intermittently knitted into its facing layer and backing layer.

Further, the present invention provides a spacer fabric having variable regions of support knitted in at predetermined zones throughout the facing layer and backing layer of such a fabric.

Still further, the present invention provides a spacer fabric that has at least two differing levels of elasticity in its facing and/or backing layers.

Yet further, the present invention provides a circularly knit undergarment using a spacer fabric that has at least three levels of modulus of elasticity selectively knit therein.

Yet still further, the present invention provides a circularly knit spacer fabric having zones of differing elasticity represented by different yarn colors or a Jacquard pattern.

Still yet further, the present invention provides a circularly knit spacer fabric having zones of differing elasticity represented by yarns of different thicknesses, the different thicknesses representing different moduli of elasticity.

Further still, the present invention provides a circularly knit spacer fabric having zones of differing elasticity represented by yarns of different textures, such as a shiny texture and a matte texture.

Also, the present invention provides such a fabric that can be used as a garment liner for support and modesty.

Further, the present invention provides such a fabric that can be used as a garment or a garment component.

Still further, the present invention provides such a spacer fabric that can be molded or used in a cut-and-sew garment.

A fabric having a first surface, a second surface opposite the first surface and an intermediate surface between the first surface and the second surface is provided. At least one of the first surface and the second surface is knitted with at least one elasticized yarn at at least one predetermined zone to provide a selected zone of elasticity to at least one of the first surface or the second surface of the fabric.

BRIEF DESCRIPTION OF THE DRAWINGS

The foregoing and still other objects and advantages of the present invention will be more apparent from the following detailed explanation of the preferred embodiments of the invention in connection with the accompanying drawings.

DETAILED DESCRIPTION OF THE INVENTION

Figure 1:
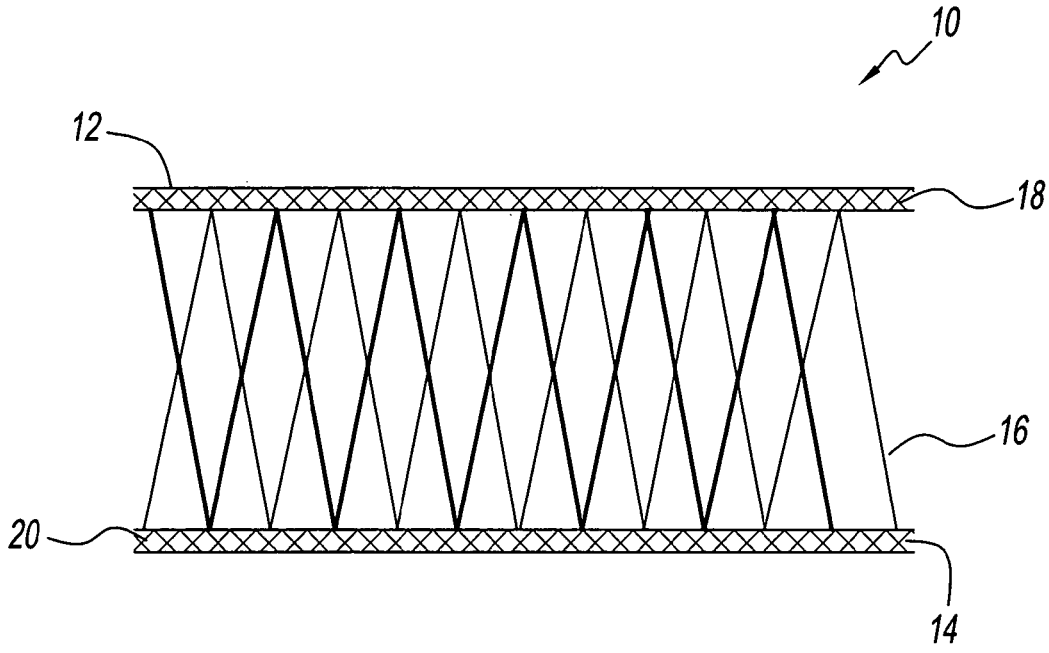
Fig. 1 (Prior Art)
FIG. 1 illustrates a schematic side view of a spacer fabric of prior art.

Referring to the drawings and, in particular, FIG. 1, there is shown a spacer fabric of the prior art, generally represented by reference numeral 10. Spacer fabric 10 is preferably a three-dimensional material, having a facing surface 12, a backing surface 14 and a spacer layer 16 between layers 12 and 14. Spacer layer 16 lies in a direction that is preferably orthogonal to facing surface 12 and backing surface 14. Spacer layer 16 provides a degree of thickness to spacer fabric 10 that would not otherwise exist.

Figure 2:
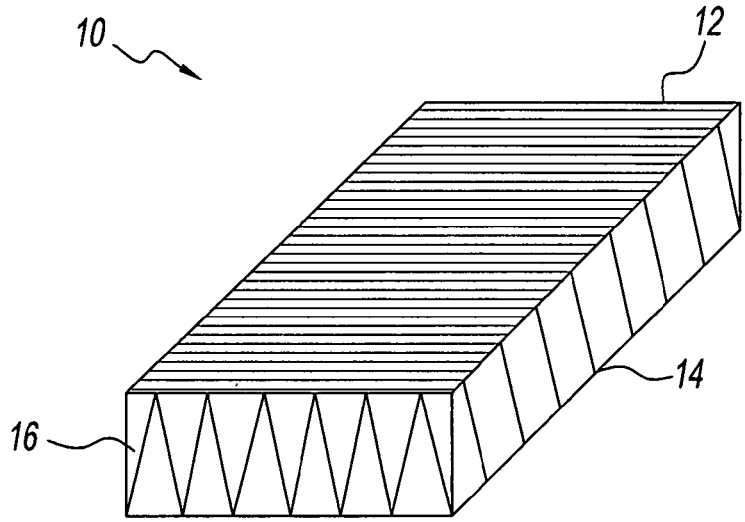
Fig. 2 (Prior Art)
FIG. 2 illustrates a schematic perspective view of a spacer fabric of the prior art.

As shown in FIG. 2, prior art fabric 10 has three yarn systems. A first yarn system 18 forms facing surface 12, a second yarn system 20 and a third yarn system 22 that connects the first and second yarn systems 18 and 20 to form fabric 10. Spacer fabric 10 is generally knitted to have a Jacquard pattern on the facing layer for aesthetic and functional benefits.

Figure 3:
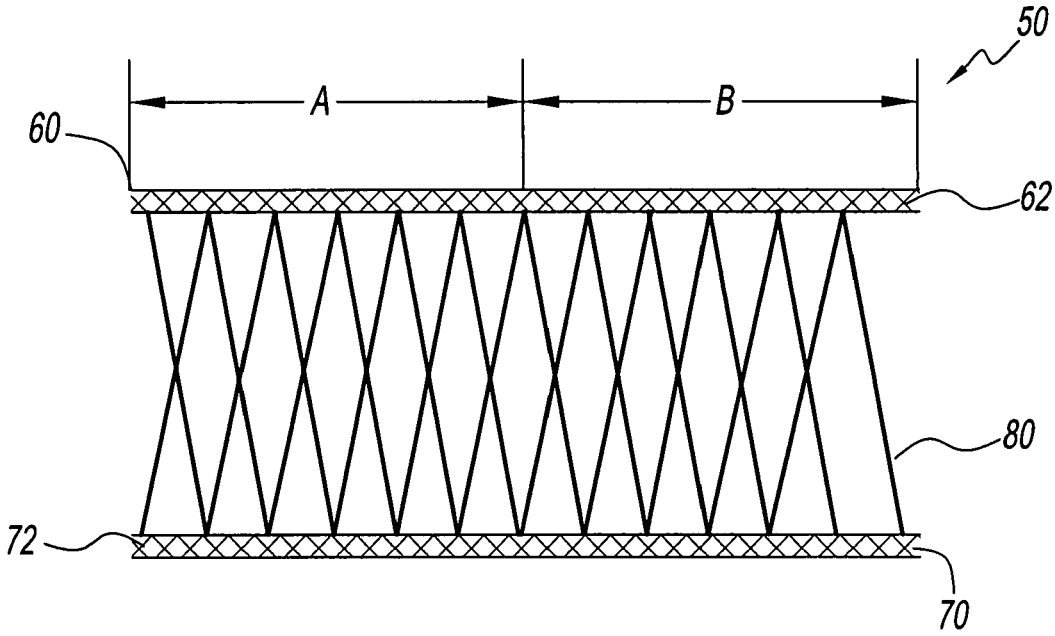
FIG. 3 illustrates a schematic side view of the spacer fabric of the present invention.

The spacer fabric of the present invention, as shown in FIG. 3, is generally represented by reference numeral 50. Spacer fabric 50 has a facing layer 60, a backing layer 70 and a spacer layer 80. Spacer layer 80 connects facing layer 60 and backing layer 70 together during the circular knitting process. Spacer layer 80 of the present invention, like that of the prior art, provides a degree of thickness to spacer fabric 50. Spacer fabric 50 is knitted on a computer controlled circular knitting machine, having a cylinder and a dial, commonly used for circularly knitting spacer fabric.

Figure 4:
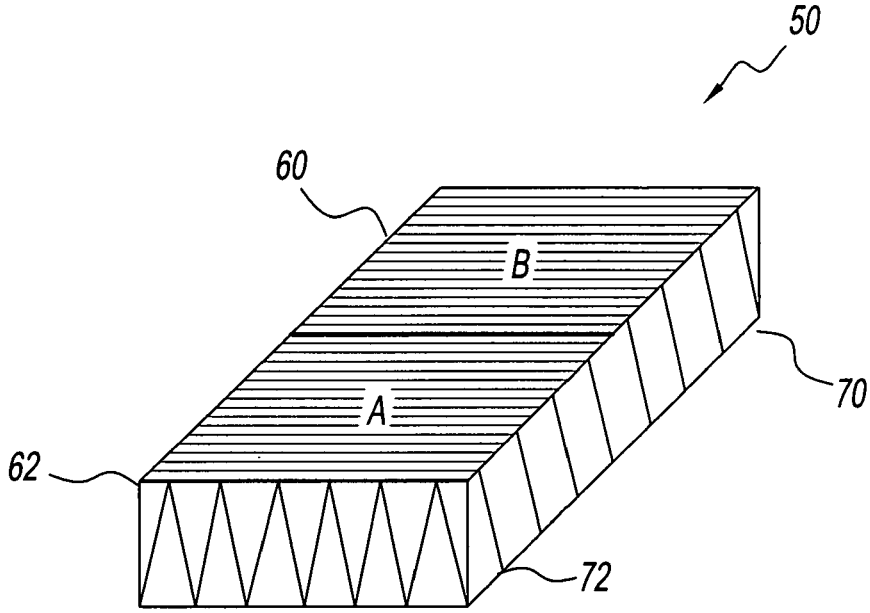
FIG. 4 illustrates a schematic perspective view of the spacer fabric of the present invention.
Figure 5:
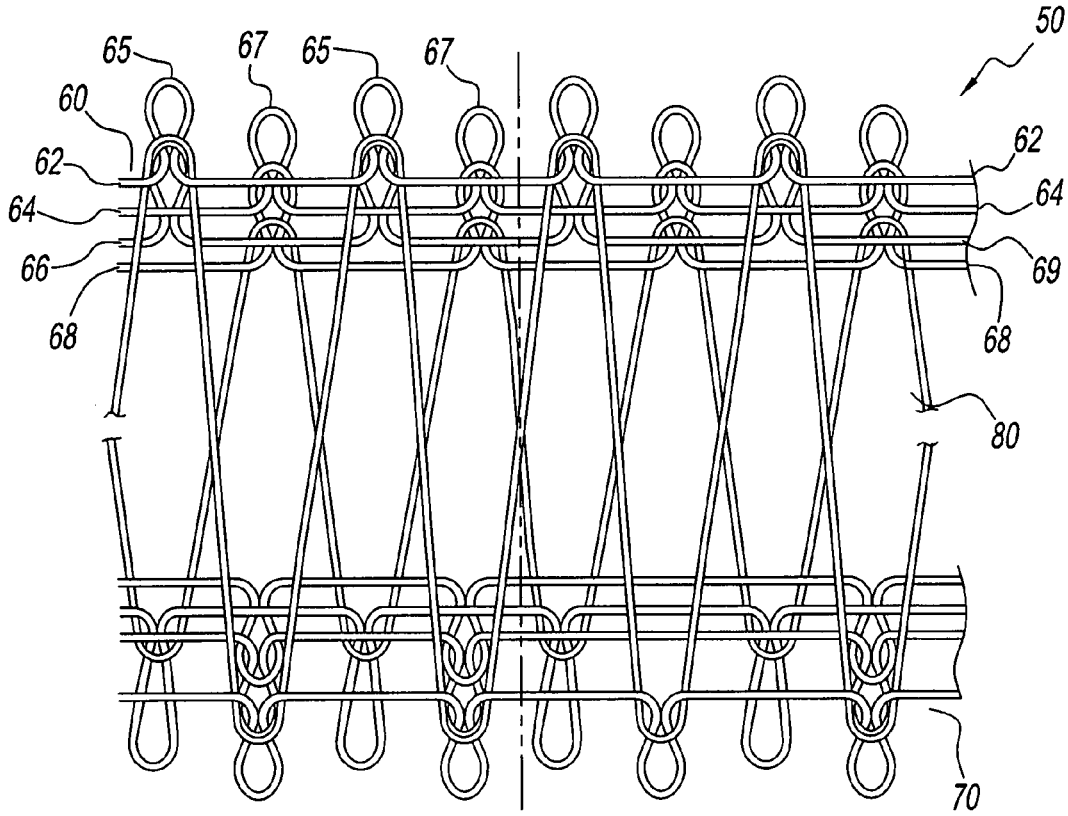
FIG. 5 illustrates a close-up view of the spacer fabric of the present invention.

Referring to FIGS. 3 through 5, facing layer 60 of spacer fabric 50 has two zones, Zone A and Zone B that each have a different modulus of elasticity. Zone A has a lower modulus of elasticity than Zone B. Zone A of facing layer 60 includes at least one non-elasticized, yarn 62. Zone B includes at least one non-elasticized yarn 62 and one elasticized yarn 69 to increase the modulus of the spacer fabric 50 in Zone B. When facing layer 60 is knitted, yarns 62 and 66 form alternating wales 65. When backing layer 70 is knitted, yarns 64 and 68 form alternating wales 67 of Zone A. When the circular knitting machine stops knitting Zone A and starts knitting Zone B, non-elasticized yarn 66 is trapped by the knitting needle and the same needle releases elasticized yarn 69 to knit Zone B. The switch of yarn 66 with yarn 69 is performed automatically and is preprogrammed by the computer that controls the circular knitting machine. By automatically switching yarn 66 for yarn 69, the modulus of elasticity of spacer fabric 50 is selectively increased in Zone B. Selectively modifying the modulus of elasticity of the spacer fabric 50 by removing the non-elasticized yarn and introducing the elasticized yarn, allows the fabric to be engineered to meet specific garment or fabric criteria.

Spacer fabric 50 is shown as incorporating a single elasticized yarn 69. However, several or a plurality of elasticized yarns could be exchanged with non-elasticized yarns to create a spacer fabric with higher percentage of elasticized yarns relative to non elasticized yarns. The resultant garment or piece of fabric would have a high degree of elasticity in predetermined regions relative to the non-elasticized or lower elasticized regions. More elasticized yarns would provide greater power to certain types of garments, for example, shapewear and athletic wear garments. For example, a covered Spandex™ could be incorporated into the elasticized zone of the spacer fabric to create a zone of enhanced elasticity and control. Further, the modulus of elasticity of backing layer 70 could also or alternatively be modified to introduce or remove elasticized or non-elasticized yarns to further enhance or reduce the modulus of elasticity of spacer fabric 50. Additionally, by intermittently and selectively exchanging elasticized and non-elasticized yarns any number of zones of varied moduli of elasticity can be introduced into spacer fabric 50. By modifying the moduli of elasticity in facing surfaces 60 and 70, respectively, higher levels of power or reduced levels of power can be achieved in adjacent zones of the spacer fabric 50 than would otherwise be possible.

Alternatively, spacer fabric 50 of the present invention can be circularly knitted to form undergarments, such as, for example, a brassiere, panty or a brief, although other garments could also be knitted. Further, the relative thickness of the spacer layer 80 compared to the facing surfaces 60 and 70, the spacer fabric is ideally suited as a liner for both brassieres and panties.

Figure 6:
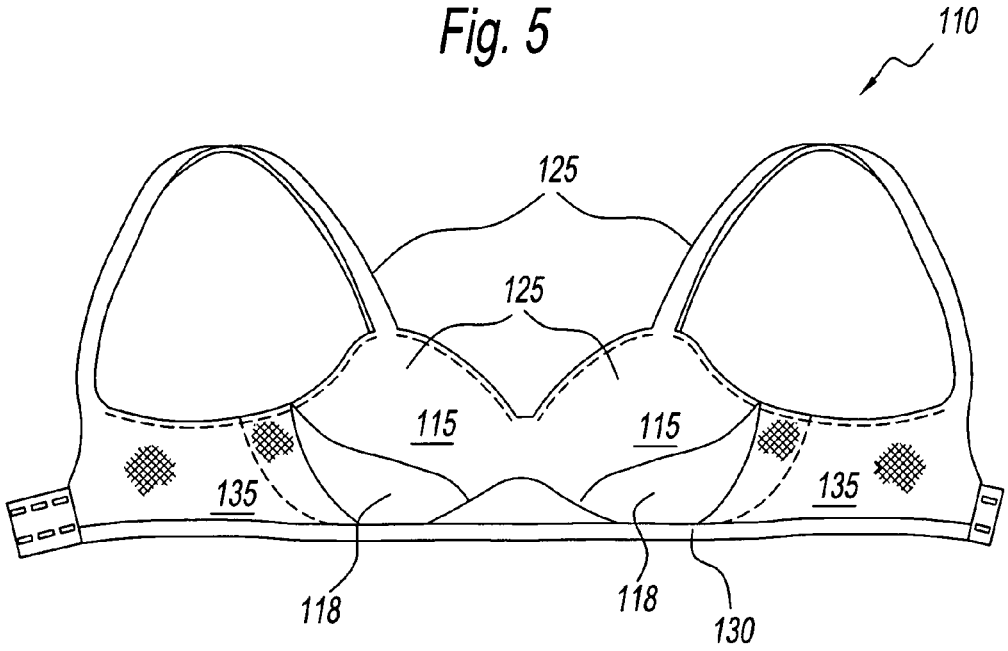
FIG. 6 illustrates a schematic perspective view of the spacer fabric of the present invention formed in a brassiere.

Referring to FIG. 6, a circularly knitted seamless brassiere 110 is knitted using a spacer fabric 50. Brassiere 110 has a pair of breast-receiving cups 115, a pair of shoulder straps 125, a torso-encircling band 130 and side panels 135 having commonly known fasteners to secure brassiere 110 about the torso of the wearer. Brassiere cups 115, and torso encircling band 130 and side panels are knitted to provide multiple zones of modified elasticity. Breast receiving cups 115 have at least two zones of varied control and support. Lower support portion 118 of cup is knitted to have a higher modulus of elasticity than upper support portion 120. Torso-encircling band 130, preferably a turned welt or a fold region, is knitted to have high a modulus of elasticity. Torso-encircling band 130 is knitted using preferably 235 den Spandex™ with a single cover of textured polyester to provide a high level of control and support in this zone, although more powerful yarns could also be used. Side panels 135 have a low modulus of elasticity to allow for easy movement of the user during wear. The yarns that are knitted to form breast-receiving cups 115, torso-encircling band 130 and side panels 135 are pre-programmed into the computer of the circular knitting machine.

The unique benefit of the spacer fabric that has variable moduli of elasticity is that such fabric is or can be engineered according to the desired specifications of a garment or a piece of fabric. When a garment is knitted from spacer fabric to include variable moduli of elasticity in critical zones as needed, or desired, the finished garment will have the functionality of a cut-and-sew garment with the aesthetics of a circularly knit seamless garment. The added support offered by the garment knitted from the spacer fabric of the present invention may be hidden from view or shown depending upon the desired aesthetics for a particular garment or piece of fabric. The finished garment has multiple zones of variable moduli of elasticity without additional sewing or manual steps. Further, the reduction of time in making the garment reduces manufacturing costs. Additionally, any lamination steps to provide additional thickness and modesty or support to the garment are also eliminated because the spacer layer of the garment provides the added thickness and loft.

The spacer fabric of the present invention differs from other spacer fabric in that an individual garment is knitted having selected regions of elasticity in predetermined zones. Conventionally, an entire width of spacer fabric is knitted having a uniform elasticity throughout the entire fabric. According to the present invention, regions of elasticity of the spacer fabric are knitted using, for example, a pre-programmed circular knitting machine connected to a striper unit to knit a spacer fabric or garment containing a pattern or other desired configuration of elasticized yarns.

Alternatively, the spacer fabric 50 of the present invention can have additional applicability. Spacer fabric 50 can be used in undergarments, as for example a liner, to provide support and coverage and/or modesty to the undergarment. The spacer fabric 50 can be used as a liner, by way of example, in a cup region of a brassiere, a panty or brief to provide enhanced coverage beneath the outer material of the undergarment.

Further, the spacer fabric 50 can be knitted using a variety of yarn and stitch combinations. Referring to FIG. 3, the spacer fabric 50 could be knitted using a bare spandex in the fabric. To reduce the elasticity or to modify the elasticity, textured polyester could be added to reduce the overall elasticity of the spacer fabric in critical areas. Additionally, covered spandex is preferably introduced into spacer fabric to control the modulus of the garment during knitting. The covered spandex preferably provides differing levels of power and modulus depending upon application. Different count options, preferably 70, 140, 235 and up to and including 300 den Spandex™ yarns with a single cover of textured polyester. By introducing the different count options in a single piece of spacer fabric or a garment, several power levels can be achieved in a single engineered piece of spacer fabric or a garment.

The spacer fabric 50 of the present invention is knitted on a circular knitting machine. The circular knitting machine preferably has a striper unit that is controlled by a computer that controls the machine. The introduction and removal yarns to create the spacer fabric 50 is achieved by striper units that are attached or connected to the cylinder of the circular knitting machine. These units contain appendages that hold separate yarns 62, 64, 66 and 68 that are knitting the facing layer 60 and backing layer 70, respectively, of the spacer fabric 50. The movement of the appendages automatically trap yarns and release other yarns simultaneously to introduce and remove the desired yarns to thus modify the modulus of elasticity of the spacer fabric 50, as desired. The unit appendages are activated by computer controls that are pre-programmed in the circular knitting machine to introduce or remove the appendages from the knitting needles once per revolution.

The location of the yarn exchanges can be controlled to provide the desired elasticity in various locations on the fabric. For example, if a brassiere 110 is being knitted, side bands 135 could be knitted to increase the degree of elasticity by knitting in elasticized yarns while non-elasticized yarns are removed. The yarns are preferable exchanged in the facing layer 60 and backing layer 70 of the spacer fabric 50.

Spacer fabric 50 can be treated or knitted to add specific functionality to a subsequently produced garment or garment component. For example, a spacer fabric 50 can be molded to form breast-receiving cups. The resultant cup would not only have regions of varied modulus of elasticity but would also have the desired molded shape. In a brassiere, adjacent zones could be knitted having different degrees of elasticity. In a pair of panties, the portion of the garment proximate the stomach could be knitted to have a high modulus of elasticity, while the adjacent regions to have a lower modulus of elasticity.

Figure 7:
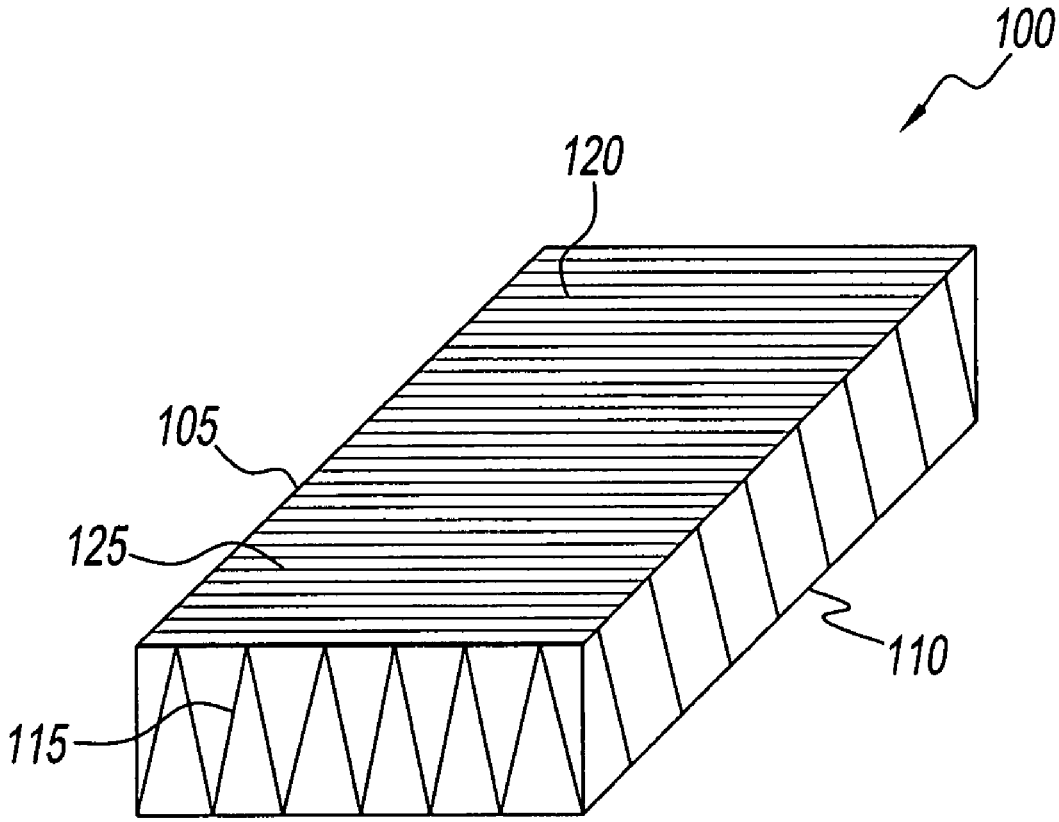
FIG. 7 illustrates a schematic perspective view of the spacer fabric of the present invention having different zones of elasticity represented by different colors.

Further, spacer fabric can be knitted to provide an aesthetic complement to the functional benefits of the spacer fabric or garment knitted with predetermined zones of elasticity. Referring to FIG. 7, a spacer fabric 100 having a facing surface 105, a backing surface 110 and a spacer layer 115, is shown. Facing layer 105 is knitted to have a zone 120 having a greater modulus of elasticity than zone 125. Backing surface 110 has an elasticity lower that either zone 120 or zone 125. Zone 120 is knitted using, for example, a red colored yarn and zone 125 is knitted using a white yarn and backing surface is knitted in a matte texture.

Figure 8:
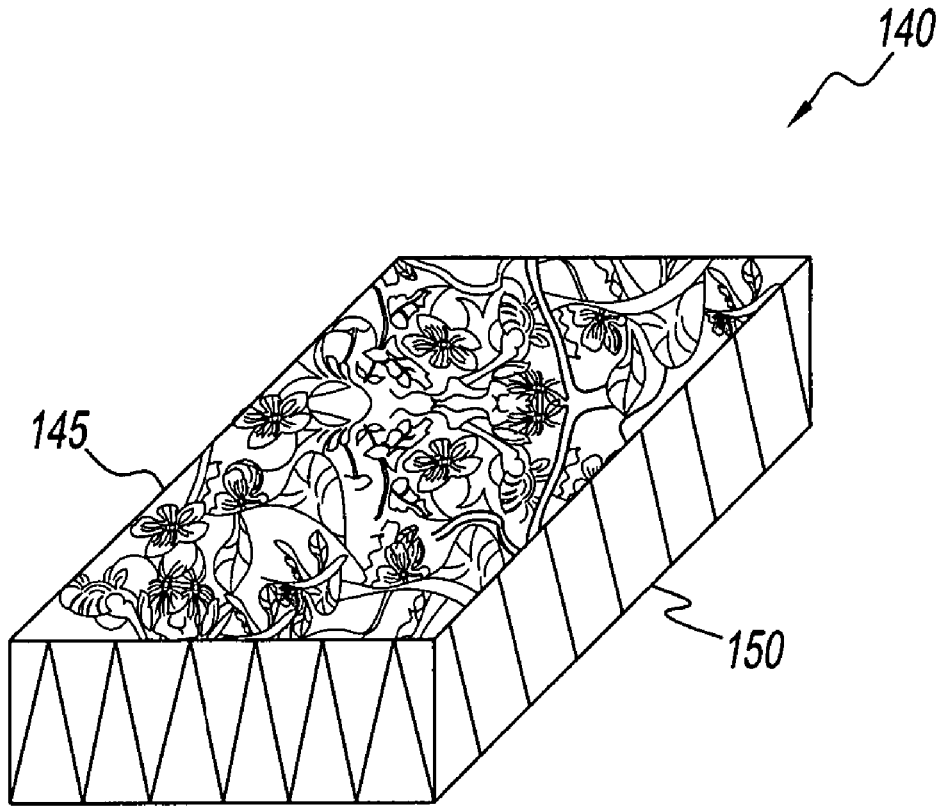
FIG. 8 illustrates a schematic perspective view of the spacer fabric of the present invention having different zones of elasticity represented by a pattern, wherein the different elements of the pattern have different modulus of elasticity.

Alternatively, as shown in FIG. 8, spacer fabric 140 has a facing surface 145, a backing surface 150 and a spacer layer 155. Facing surface 145 is knitted using a decorative pattern, for example, a Jacquard pattern with different components of the design knitted using different colors, wherein the different colors represent yarns of different elasticity. Backing surface 150 is knitted using, for example, either a Jacquard of a shiny finish yarns. In all knitting combinations using variable modulus, the elasticized and non-elasticized yarns are used to create the visual pattern, of the same or different color, thus creating different zones of elasticity. The same distinction in power between or among selected zones of variable modulus can also be made using yarns of different thickness.

For example, a facing layer can be treated to be de-lustered or printed with a desired pattern, in which the pattern is established using elasticized and non-elasticize yarns. Alternatively, a facing layer can be knitted with a Jacquard pattern or have an embroidered pattern thereon, in which the pattern is knitted using yarns of differing moduli. Additionally, either facing layer or backing layer can be knitted to have a shiny finish or a matte finish to create a distinctive visual appearance in the garment or fabric. Further, either facing or backing layer can be knitted to have regions of alternating or differing shine or matte regions or colors. Further, the facing layer can be knitted with three different colors represented. Additionally, the facing layer and the backing layer can be knitted to have a shiny finish or a matte finish to create a distinctive visual appearance for both sides of the fabric or garment.

An increase in weight or a reduced weight of the spacer fabric results from the use of various modulus Spandex™ yarns. The increase or reduction in weight changes the transparency or opacity of the spacer fabric by modifying its density.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

We claim:

1. A spacer fabric comprising:

a first layer;

a second layer opposite said first layer; and a spacing layer between said first layer and said second layer, the first layer, the second layer and the spacing layer forming the spacer fabric;

wherein the first layer is comprised of a first portion and a second portion, the first portion is knitted with at least one elasticized yarn, the second portion has a different elasticity than the first portion.

2. The spacer fabric according to claim 1, wherein said second layer is comprised of a first and a second portion, wherein the first portion of the second layer is knitted with at least one elasticized yarn.

3. The spacer fabric according to claim 2, wherein each of said first portions of the first and second layers have an increased elastic modulus compared to each of said second portions.

4. The spacer fabric according to claim 1, wherein said first and second portions are knitted with different colored yarns.

5. The spacer fabric according to claim 1, wherein said first and second portions of said first layer are knitted to form a Jacquard pattern on said first layer.

6. The spacer fabric according to claim 1, wherein said first and second portions are knitted with yarns of different thicknesses.

7. The spacer fabric according to claim 1, wherein said fabric is knitted to form one of a brassiere, brassiere liner, panty, panty liner or a garment of shapewear.

8. A spacer fabric knit on a circular knitting machine, said fabric comprising:

a first layer;

a second layer;

a spacer layer between said first layer and said second layer, the first layer, the second layer and the spacing layer forming the spacer fabric;

Wherein each of the first and second layers are comprised of a first portion and a second portion, each of the first portions are knitted with at least one elasticized yarn, and each of the second portions has a different elasticity than each of the first portions.

9. The spacer fabric according to claim 8, wherein each of the first portions in said first layer and said second layer are knitted using a plurality of elasticized yarns.

10. The fabric according to claim 8, wherein each of said first and second portions are knitted with different colored yarns.

11. The fabric according to claim 8, wherein each of said first portions of said first layer are knitted to form a Jacquard pattern on said first layer.

12. The fabric according to claim 1, wherein said first and second portions are knitted using yarns of different thicknesses.

13. The fabric according to claim 8, wherein said spacer fabric is knitted to form one of a brassiere, brassiere liner, panty, panty liner or a garment of shapewear.

14. A brassiere comprising:

a pair of breast receiving cups;

a pair of side panels, one of each of the pair of side panels connected to one of the pair of breast-receiving cups;

wherein each of the pair of breast-receiving cups having a knit spacer fabric; the knit spacer fabric comprising a first layer;

a second layer;

a spacer layer between said first layer and said second layer;

wherein the first layer is comprised of a first portion and a second portion, the first portion comprised of at least one elasticized yarn, the second portion has a different elasticity than the first portion, and each breast receiving cup of the pair of breast receiving cups has at least one of the first and second portions.

15. The brassiere according to claim 14, wherein said second layer is comprise of a first and a second portion, the first portion of the second layer is knitted using at least one elasticized yarn.

16. The brassiere according to claim 14, wherein said first portion has an increased elastic modulus compared to said second portion.

17. The brassiere according to claim 14, wherein said first and second portions are knitted with different colored yarns.

18. The brassiere according to claim 14, wherein said first and second portions of said first layer are knitted to form a Jacquard pattern on said first layer.

19. The brassiere according to claim 14, wherein said first and second portions are knitted using yarns of different thicknesses.

* * * * *